US008437494B2

(12) United States Patent
Suzuki et al.

(10) Patent No.: US 8,437,494 B2
(45) Date of Patent: May 7, 2013

(54) MOUNT STRUCTURE OF ELECTROMECHANICAL ACOUSTIC TRANSDUCER

(75) Inventors: Shinya Suzuki, Shizuoka (JP); Yukinari Inoue, Shizuoka (JP)

(73) Assignee: Panasonic Corporation, Osaka (JP)

( * ) Notice: Subject to any disclaimer, the term of this patent is extended or adjusted under 35 U.S.C. 154(b) by 783 days.

(21) Appl. No.: 12/302,186

(22) PCT Filed: May 24, 2006

(86) PCT No.: PCT/JP2006/310349

§ 371 (c)(1),
(2), (4) Date: Nov. 24, 2008

(87) PCT Pub. No.: WO2007/135740

PCT Pub. Date: Nov. 29, 2007

(65) Prior Publication Data

US 2009/0232343 A1 Sep. 17, 2009

(51) Int. Cl.
*H04R 1/02* (2006.01)

(52) U.S. Cl.
USPC ..... 381/386

(58) Field of Classification Search ..... 381/386, 381/423, 351, 186, 396, 395; 181/166, 207
See application file for complete search history.

(56) References Cited

U.S. PATENT DOCUMENTS

| | | | | |
|---|---|---|---|---|
| 6,145,186 | A * | 11/2000 | Beavers | 29/594 |
| 7,113,813 | B2 | 9/2006 | Shimokawatoko et al. | |
| 2003/0003879 | A1 * | 1/2003 | Saiki et al. | 455/90 |
| 2003/0059079 | A1 * | 3/2003 | Asahina et al. | 381/396 |
| 2003/0076969 | A1 | 4/2003 | Han et al. | |
| 2004/0043801 | A1 | 3/2004 | Shimokawatoko et al. | |
| 2004/0071309 | A1 * | 4/2004 | Furuya et al. | 381/424 |

FOREIGN PATENT DOCUMENTS

| | | | |
|---|---|---|---|
| CN | 1465205 | A | 12/2003 |
| EP | 1 538 871 | A2 | 6/2005 |
| EP | 1 599 065 | A1 | 11/2005 |
| JP | 2001-127858 | A | 5/2001 |
| JP | 2002-171596 | A | 6/2002 |
| WO | 03-007651 | A1 | 1/2003 |
| WO | 2005/046067 | A1 | 5/2005 |

OTHER PUBLICATIONS

International Search Report for PCT/JP2006/310349; Jun. 12, 2006.

(Continued)

*Primary Examiner* — Zandra Smith
*Assistant Examiner* — Lawrence Tynes, Jr.
(74) *Attorney, Agent, or Firm* — Seed IP Law Group PLLC

(57) ABSTRACT

To provide a mount structure of an electromechanical acoustic transducer which enables making of an attempt to pursuit miniaturization while maintaining an acoustic characteristic. A cylindrical closed-end yoke 13 is attached to a frame 12, which is attached to an interior surface 11*b* of a housing 11 by way of a wall portion 19, in a direction where a bottom 13*b* of the yoke approaches the housing 11; hence, a sound channel 14 is defined between the yoke 13 and the wall portion 19 without an increase in the thickness of the electromechanical acoustic transducer. A superior acoustic characteristic can hereby be acquired. Alternatively, the sound channel 14 can be assured even when the electromechanical acoustic transducer is miniaturized, and thus an attempt can be made to pursuit miniaturization while maintaining an acoustic characteristic.

10 Claims, 10 Drawing Sheets

OTHER PUBLICATIONS

Extended European Search Report, dated Jun. 19, 2012, for corresponding European Application No. 06756555.6, 6 pages.

Second Office Action, for corresponding Chinese Application No. 2006800546921, issued Dec. 12, 2011, 10 pages (with English Translation).

* cited by examiner

MOUNT STRUCTURE OF ELECTROMECHANICAL ACOUSTIC TRANSDUCER

TECHNICAL FIELD

The present invention relates to a mount structure of an electromechanical acoustic transducer, such as a speaker and a microphone, which is accommodated in a housing having a sound port.

BACKGROUND ART

As shown in FIG. 10, a speaker 100 that is a related-art common electromechanical acoustic transducer has a housing 101 having a sound port 101*a* at the center portion of the housing 101, and an essentially-plate-shaped frame 103 is attached to an interior surface 101*b* of the housing 101 through an rising portion 102 so as to generate an internal space 104.

A cylindrical closed-end yoke 105 supported in correspondence with the internal space 104 is attached to the center portion of the frame 103. A magnet 106 is attached to the inside of a bottom 105*a* of the yoke 105, and a magnetic gap 107 is formed between an interior surface of the yoke 105 and the magnet 106.

A plate 108 is attached to an apical surface of the magnet 106. A voice coil 109 is inserted in the magnetic gap 107. One end of the voice coil is attached to the bottom 105*a* of the yoke 105, and the other end of the voice coil 109 is attached to the center portion of a diaphragm 110.

A protector 111 for protecting the diaphragm 110 is provided in front of the diaphragm 110, and first air holes 111*a* are provided in the protector 111, and second air holes 103*a* are provided in the frame 103.

In such a speaker 100, the bottom 105*a* of the yoke 105 is arranged so as to face from the interior surface 101*b* of the housing 101 toward a departing direction (a downward direction in FIG. 10). Since the yoke 105 is smaller in diameter than the frame 103, a space exists between the frame 103 and another electronic component M housed in the housing 101.

In order to achieve a superior acoustic characteristic, a necessity for assuring a sufficient space around the second air holes 103*a* for producing superior resonances of sound emitted from the second air holes 103*a* to the internal space 104 of the housing 101 has commonly been known (see; for instance, Patent Document 1).

Patent Document 1: JP-A-2002-171596

DISCLOSURE OF THE INVENTION

Problem that the Invention is to Solve

Incidentally, miniaturization of a recent portable terminal device, which is equipped with a speaker 100 as an electromechanical acoustic transducer, has been sought. However, assuring a sufficient space around the second air holes 103*a* causes the inconvenience of hindering miniaturization of the housing 101.

The present invention has been conceived to solve the related-art problem and aims at providing a mount structure of an electromechanical acoustic transducer that enables making of an attempt to pursuit miniaturization while maintaining an acoustic characteristic.

Means for Solving the Problem

A mount structure of an electromechanical acoustic transducer of the present invention is a mount structure of an electromechanical acoustic transducer housed in a housing having a sound port, comprising: an essentially-hollow-plate-shaped frame attached to an interior surface of the housing; a cylindrical closed-end yoke supported in correspondence to a hollow portion of the frame; a magnet provided at a bottom of the yoke so as to form a magnetic gap between an inner side surface of the yoke and the magnet; a plate provided at an end face of the magnet; a voice coil inserted into the magnetic gap; a diaphragm that is connected to the voice coil and that is supported by the frame; a protector provided on the frame for protecting the diaphragm; a first air hole provided in the protector; and a second air hole provided in the frame, wherein the bottom of the yoke is arranged so as to be oriented in a direction where the bottom approaches an interior surface of the housing, and a wall portion is interposed between the frame and the housing.

By the configuration, the cylindrical closed-end yoke is attached to the frame, which is attached to the interior surface of the housing by way of the wall portion, in a direction in which the bottom of the yoke approaches the housing. Hence, the sound channel is defined between the yoke and the wall portion without an increase in the thickness of the electromechanical acoustic transducer.

Thus, a superior acoustic characteristic can be acquired. Alternatively, even when the electromechanical acoustic transducer is miniaturized, the sound channel can be assured; hence, there is yielded an advantage of the ability to attempt to pursuit miniaturization while maintaining an acoustic characteristic.

The mount structure of an electromechanical acoustic transducer of the present invention has a configuration in which an interposition member having adhesiveness is sandwiched between the housing and the bottom of the yoke.

Moreover, the mount structure of an electromechanical acoustic transducer of the present invention has a configuration in which the wall portion has elasticity.

Further, the mount structure of an electromechanical acoustic transducer of the present invention has a configuration in which the wall portion has a damping characteristic.

The mount structure of an electromechanical acoustic transducer of the present invention further comprises a protector cutout portion formed in the protector, as well as having a configuration in which the protector cutout portion is provided so as to establish mutual communication between front and back of the protector in a direction crossing a direction of movement of the voice coil.

Further, the mount structure of an electromechanical acoustic transducer of the present invention has a configuration in which the frame has an rising portion which stands in a thickness direction and a frame cutout portion formed in the rising portion; and in which the frame cutout portion is provided so as to establish mutual communication between inside and outside of the rising portion along a direction crossing the direction of movement of the voice coil.

The mount structure of an electromechanical acoustic transducer of the present invention further comprises a support member interposed between the frame and an electronic component housed in the housing, as well as having a configuration in which the support member has elasticity.

The mount structure of an electromechanical acoustic transducer of the present invention further comprises a support member interposed between the frame and an electronic component housed in the housing, as well as having a configuration in which the support member has a damping characteristic.

Advantage of the Invention

By the configuration, the cylindrical closed-end yoke is attached to the frame, which is attached to the interior surface of the housing by way of the wall portion, in a direction in which the bottom of the yoke approaches the housing. Hence, the sound channel is defined between the yoke and the wall portion without an increase in the thickness of the electromechanical acoustic transducer, so that a superior acoustic characteristic can be acquired. Alternatively, even when the electromechanical acoustic transducer is miniaturized, the sound channel can be assured; hence, there can be provided a mount structure of an electromechanical acoustic transducer that yields an advantage of the ability to attempt to pursuit miniaturization while maintaining an acoustic characteristic.

DESCRIPTIONS OF THE REFERENCE NUMERALS

Figure 1:
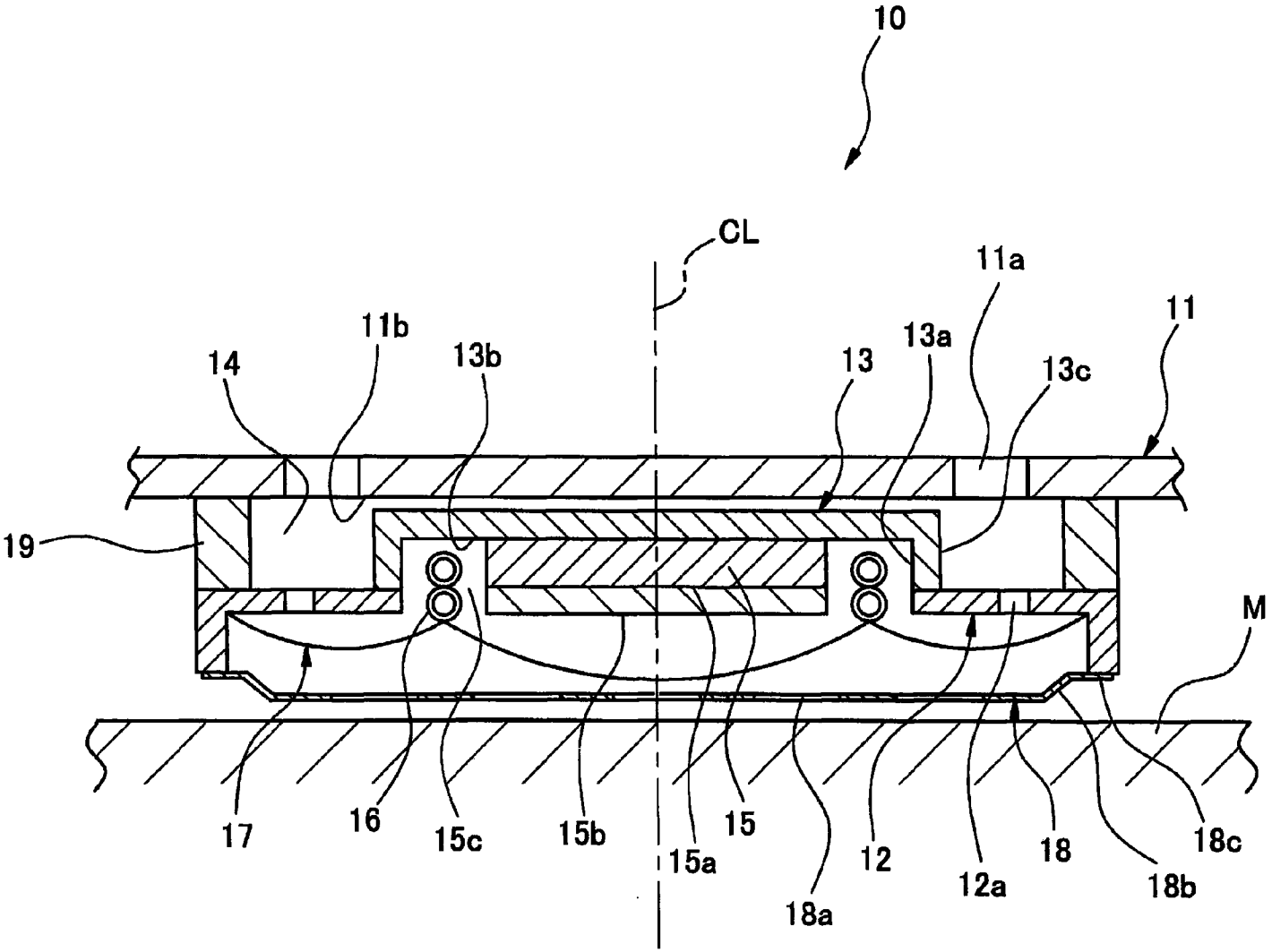
FIG. 1 is a structural view showing a mount structure of an electromechanical acoustic transducer of a first embodiment of the present invention.

10 mount structure of electromechanical acoustic transducer
11 housing
11*a* sound port
12 frame
12*a* second air hole
13 yoke
13*a* interior surface
13*b* bottom
15 magnet
15*a* end face
15*b* plate
15*c* magnetic gap
16 voice coil
17 diaphragm
18 protector
18*a* first air hole
19 wall portion
21 interposition member
51 protector cutout portion
61 rising portion
62 frame cutout portion
71 support member
81 support member
M electronic component

BEST MODES FOR IMPLEMENTING THE INVENTION

Mount structures for an electromechanical acoustic transducer of embodiments of the present invention will be described hereunder by reference to the drawings.

First Embodiment

FIG. 1 shows a mount structure of an electromechanical acoustic transducer of a first embodiment of the present invention.

In FIG. 1, a mount structure 10 of an electromechanical acoustic transducer, such as a speaker and a microphone, of a first embodiment has an essentially-hollow-plate-shaped frame 12 attached to an interior surface 11*b* of a housing 11 having sound ports 11*a*; an end-closed cylindrical yoke 13 supported in correspondence to a hollow of the frame 12; a magnet 15 provided on a bottom 13*b* of the yoke 13 so as to generate a magnetic gap 15*c* between the magnet and an interior surface 13*a* of the yoke 13; a plate 15*b* provided at an end face 15*a* of the magnet 15; a voice coil 16 inserted into the magnetic gap 15*c*; a diaphragm 17 that is connected to the voice coil 16 and that is supported by the frame 12; and a protector 18 provided on the frame 12 for protecting the diaphragm 17.

First air holes 18*a* are provided in the protector 18, and second air holes 12*a* are provided in the frame 12.

The bottom 13*b* of the yoke 13 is arranged so as to be oriented toward an approaching direction with respect to the interior surface 11*b* of the housing 11 (an upward direction in FIG. 1), and a wall portion 19 is interposed between the frame 12 and the housing 11.

Sound ports 11*a* cut into; for instance, a plurality of circular-arc segments of a circle that is around a center portion line CL are provided in the housing 11. The wall portion 19 is concentrically provided outside the sound ports 11*a*, and the frame 12 is attached to an interior end face of the wall portion 19.

The second air holes 12*a* provided in the frame 12 are provided opposite the sound ports 11*a* of the housing 11 at the inside of the wall portion 19 in the form of circular-arc segments of a circle.

The center portion of the frame 12 is cut into a circular shape, and the end-closed cylindrical yoke 13 is provided so as to protrude toward the housing 11.

Accordingly, a sound channel 14 surrounded by the housing 11, the wall portion 19, the frame 12, and a longitudinal wall portion 13*c* of the yoke 13 is defined. The sound ports 11*a* are provided at the front of the sound channel 14, and the second air holes 12*a* are provided on the rear of the same.

The second air holes 12*a* provided in the frame 12 are intended for letting air between the frame 12 and the diaphragm 17 escape and guides the sound generated by the diaphragm 17 to the sound ports 11*a* by way of the sound channel 14.

In the meantime, the first air holes 18*a* are provided in the protector 18, and the protector 18 is attached to a lower surface of the frame 12 through a rising portion 18*b* and a fringe 18*c*. The first air holes 18*a* are intended for letting air between the diaphragm 17 and the protector 18 escape. For instance, a plurality of circular through holes, or the like, are provided in an entirety of the protector 18.

A joint of the frame 12 facing the sound channel 14 must be airtight so as not to cause phase interference between sound emitted from the second air holes 12*a* and the sound emitted from the first air holes 18*a*. For this reason, it is desirable to assure airtight-ness for the joint between the frame 12 and the wall portion 19 by combination of mutually projecting shapes or by use of an adhesive double-sided tape.

In order to generate superior resonances of the sound emitted from the first air holes 18*a* in an internal space of the housing 11, it is desirable to make cutout portions, for which a sufficiently large area is assured, in the first air holes 18.

The protector 18 is not limited to a specific material or shape. However, it is desirable to form the protector 18 from; for instance, metal and assure a thickness that prevents anomalous sound, which would otherwise be caused by emission of sound from the electromechanical acoustic transducer.

In relation to the gap existing between the protector 18 and the component M in the housing 11, it is desirable to assure the minimum gap that prevents anomalous sound, which would otherwise be caused when the protector 18 is vibrated and contact the component M as a result of emission of sound from the electromechanical acoustic transducer.

Operation of the mount structure 10 of the electromechanical acoustic transducer will now be described by reference to FIG. 1.

For instance, an electro-dynamic speaker can be exemplified as the electromechanical acoustic transducer. When an electric signal is applied to the voice coil 16 inserted in the magnetic gap 15*c* of the electro-dynamic speaker, drive force develops in the voice coil 16, thereby vibrating the diaphragm 17 connected to the voice coil 16, to thus cause a pressure change in air in the frame 12. The pressure change generates sound to a space outside of the housing 11 by way of the sound channel 14 and the sound ports 11*a* via the second air holes 12*a*.

In the meantime, the sound generated by the first air holes 18*a* generates resonances in the housing 11. At this time, the larger becomes the volume of a space around the first air holes 18*a*, the superior an acoustic characteristic is acquired.

Next, an acoustic characteristic of the mount structure 10 of the electromechanical acoustic transducer of the present invention will be described by use of a test result by reference to FIG. 2.

Figure 2:
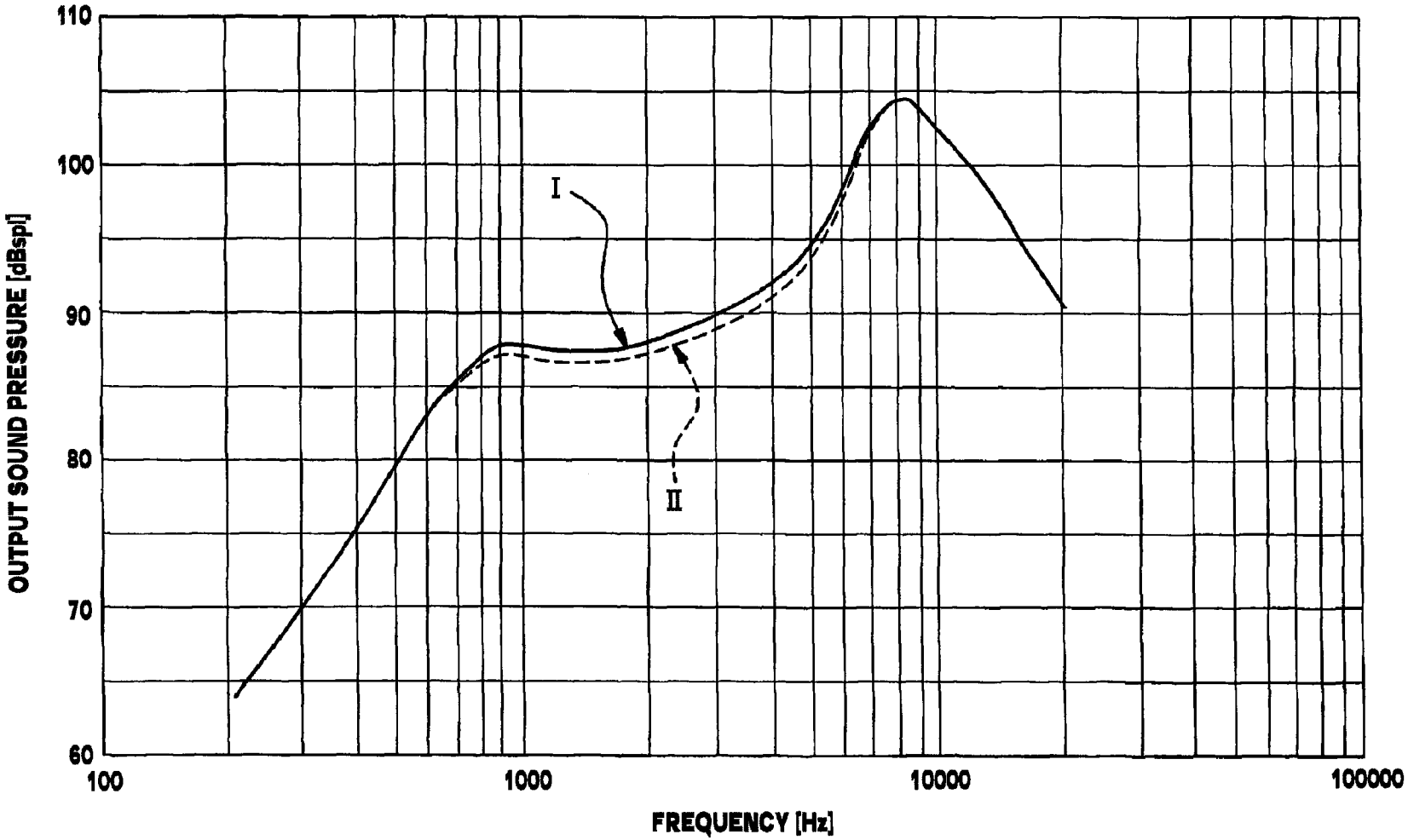
FIG. 2 is a graph showing a sound pressure frequency characteristic of the first embodiment of the present invention.
Figure 10:
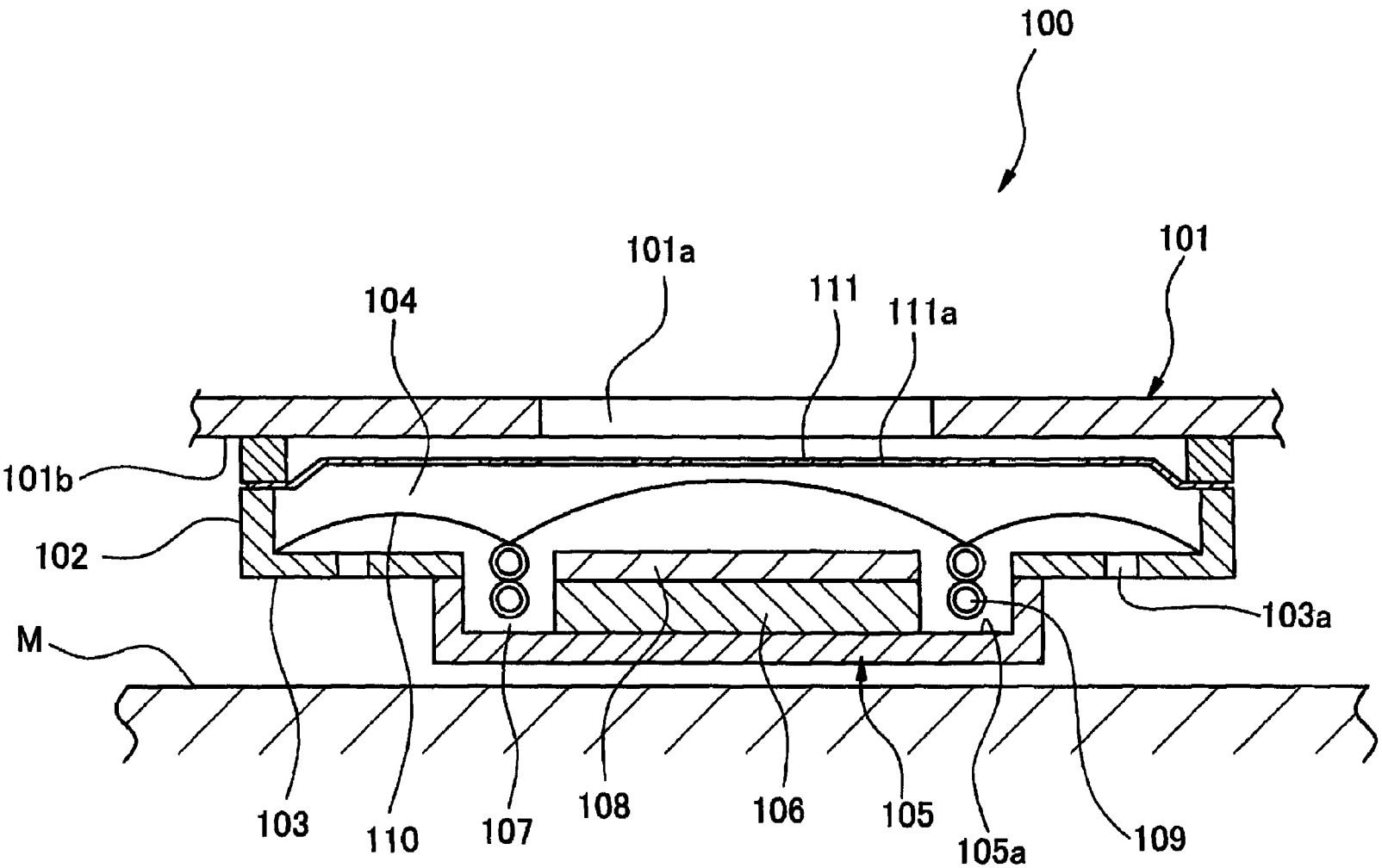
FIG. 10 is a structural view showing a mount structure of an electromechanical acoustic transducer of a related-art configuration.

FIG. 2 is a correlation diagram showing a sound pressure frequency characteristic of the speaker 100 serving as a related-art electromechanical acoustic transducer shown in FIG. 10 and a sound pressure frequency characteristic of the mount structure 10 of the foregoing electromechanical acoustic transducer of the present invention shown in FIG. 1. Specific numerical values provided below are set only for quantitatively grasping advantages of the present invention. Numerical values are illustrative, and the individual numerical values do not pose any restriction on the true nature of the present invention.

In analysis of the test shown in FIG. 2, each of the related-art speaker 100 and the mount structure 10 of the electromechanical acoustic transducer of the present invention uses an electro-dynamic speaker having a diameter ϕ of 14 mm and a thickness "t" of 2.9 mm. The housings 11 and 101 assume the same shape. A distance between the housing 11 and the component M in the housing and a distance between the housing 101 and the component positioned therein assume an identical value of 3.5 mm.

In the related-art speaker 100, a gap between the housing 101 and the protector 111 is set to 0.5 mm, and a gap between the yoke 105 and the component M in the housing is set to 0.1 mm.

In the mount structure 10 of the electromechanical acoustic transducer of the present invention, the gap between the housing 11 and the yoke 13 is set to 0.1 mm, and a gap between the protector 18 and the component M in the housing is set to 0.5 mm.

A test was analyzed by placing microphones of the same model at a position that is separated from the sound ports 11*a* by 0.1 m and by means of settings of application of 0.2 W to the related-art speaker 100 and the mount structure 10 of the electromechanical acoustic transducer of the present invention.

A characteristic I designated by a broken line in FIG. 2 represents a result of measurement of the related-art speaker 100. A characteristic II is designated by a solid line and represents a result of measurement of the mount structure 10 of the electromechanical acoustic transducer of the present invention.

As shown in FIG. 2, when compared with that of the characteristic I with a range from about 1000 Hz to 5000 Hz, a sound pressure level of the characteristic II is enhanced by about 1 dB. This generally means that the air becomes more difficult to escape from the respective air holes 18*a*, 12*b*, 111*a*, and 103*a* as the gap between the electromechanical acoustic transducer and the component M in the housing becomes narrower, to thus incur deterioration of sound pressure.

However, in the mount structure 10 of the electromechanical acoustic transducer of the present invention, the first air holes 18*a* are larger than the second air holes 12*b* by about two to five times in terms of an aperture area. Hence, escape of air from the first air holes 18*a* in the mount structure 10 of the electromechanical acoustic transducer of the present invention becomes easier than escape of air from the related-art speaker 100, which lessens deterioration of sound pressure.

Provided that deterioration of sound pressure identical with that caused by the related-art speaker 100 is allowed, the mount structure 10 of the electromechanical acoustic transducer of the present invention enables a reduction in the gap between the protector 18 and the component M in the housing 11 and a further reduction in the thickness of the speaker.

Since the electro-dynamic speaker employs the magnets 15, 106 as constituent components, there arises leakage flux to the outside of the housing 11 and 101.

In the related-art speaker 100, a component opposing the housing 101 is the protector 111. In the mount structure 10 of the electromechanical acoustic transducer of the present invention, a component opposing the housing 11 is the yoke 13. Respective components are not limited to specific materials or shapes. However, when the components are formed from; for instance, single metal, the yoke 13 is about two to four times as thick as the protector 111, and hence leakage flux to the outside of the housing 11 is reduced by about 30%.

This is significant in connection with reliability of a non-contact IC card of magnetic storage type.

In the mount structure 10 of the electromechanical acoustic transducer of the present invention, the second air holes 12*a* are made smaller than the first air holes 18*a* by about one-half to one-fifth in terms of an aperture area. When a keen object is inserted from the sound ports 11*a*, the potential of the second air holes 12*a* protecting the diaphragm 17 is enhanced, as well.

This is significant in connection with reliability achieved when equipment is put in a bag, or the like, According to the mount structure 10 of the foregoing electromechanical acoustic transducer, the cylindrical closed-end yoke 13 is attached, in a direction in which the bottom 13*b* approaches the housing 11, to the frame 12 attached to the interior surface 11*b* of the housing 11 by way of the wall portion 19. Hence, the sound channel 14 having a sufficient space is defined between the yoke 13 and the wall portion 19 without an increase in the thickness of the electromechanical acoustic transducer.

A superior acoustic characteristic can be acquired thereby. Alternatively, the sound channel 14 can be assured even when the electromechanical acoustic transducer is miniaturized, and hence an attempt can be made to pursuit miniaturization while maintaining an acoustic characteristic.

Second Embodiment

A mount structure of an electromechanical acoustic transducer of a second embodiment of the present invention will now be described.

Figure 3:
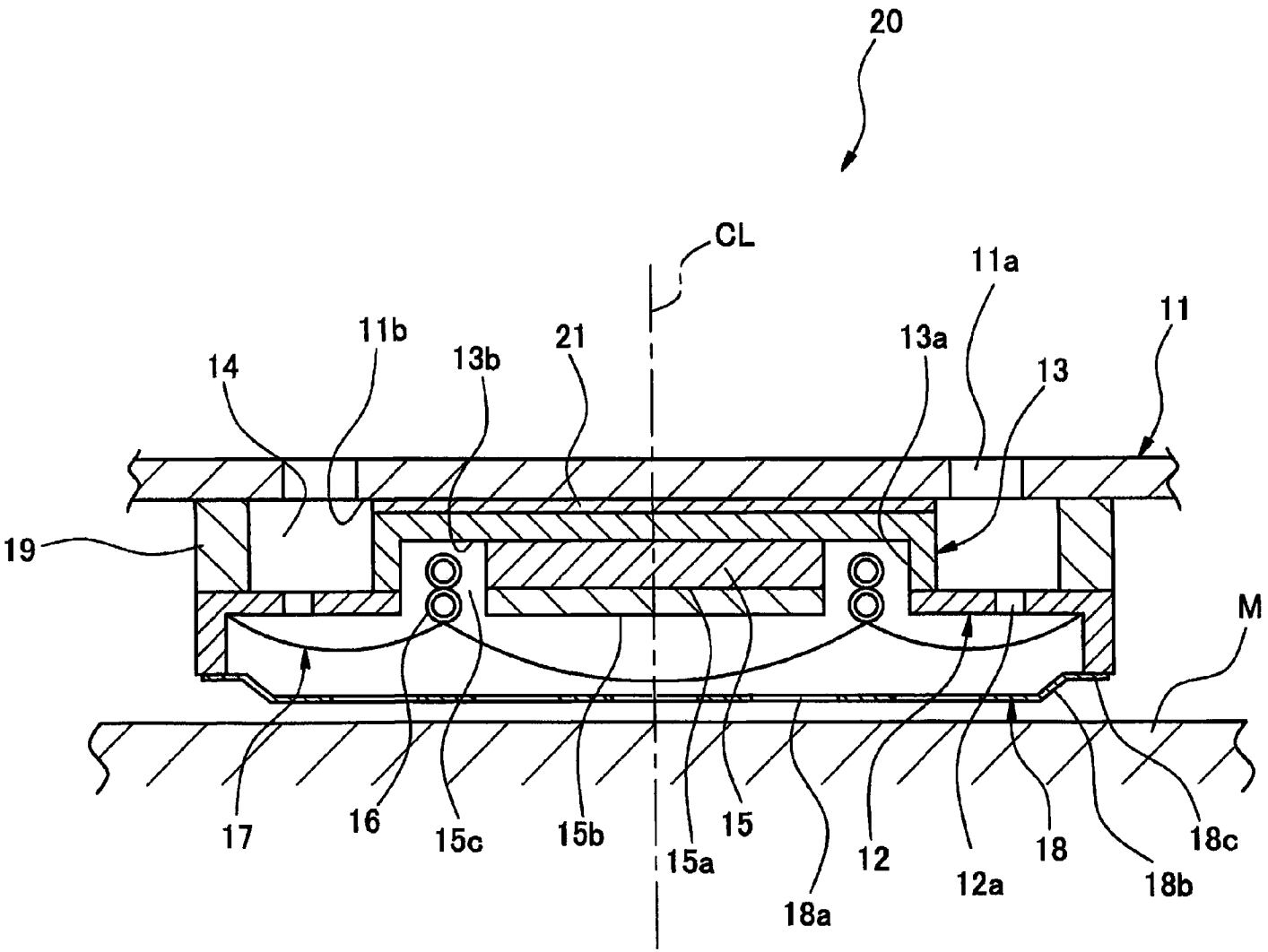
FIG. 3 is a structural view showing a mount structure of an electromechanical acoustic transducer of a second embodiment of the present invention.

A mount structure 20 of an electromechanical acoustic transducer of the second embodiment is shown in FIG. 3. Areas common to those of the mount structure 10 of the electromechanical acoustic transducer of the aforementioned first embodiment are assigned the same reference numerals, and their repeated explanations are omitted.

In the mount structure 20 of the electromechanical acoustic transducer, an interposition member 21 having an adhesiveness is sandwiched between the housing 11 and the bottom 13*b* of the yoke 13.

In the adhesive material 21, it is desirable to assure stable adhesiveness by use of; for instance, an adhesive double-sided tape.

Operation of the mount structure 20 of the electromechanical acoustic transducer is the same as that of the mount structure 10 of the electromechanical acoustic transducer described in connection with the foregoing first embodiment.

The mount structure 20 of the electromechanical acoustic transducer of the foregoing second embodiment of the present invention enables enhancement of magnetic-proof and dust-proof characteristics as well as assurance of acoustic performance as in the first embodiment. Further, the mount structure enables fastening of the yoke 13 to the housing 11 by provision of the adhesive interposition member 21 between the housing 11 and the bottom 13*b* of the yoke 13.

Third Embodiment

A mount structure of an electromechanical acoustic transducer of a third embodiment of the present invention will now be described.

Figure 4:
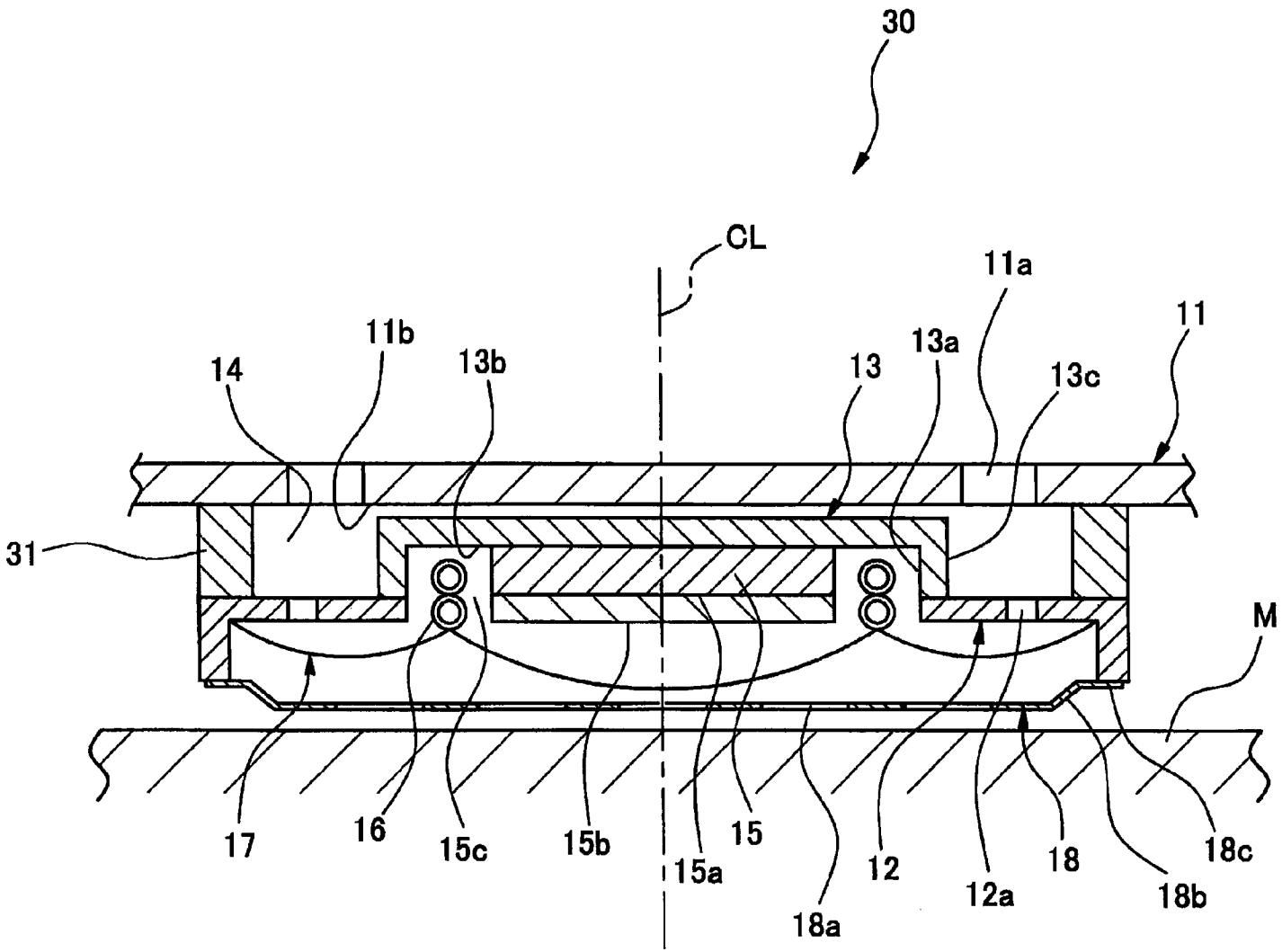
FIG. 4 is a structural view showing a mount structure of an electromechanical acoustic transducer of a third embodiment of the present invention.

A mount structure 30 of an electromechanical acoustic transducer of the third embodiment is shown in FIG. 4. Areas common to those of the mount structure 10 or 20 of the electromechanical acoustic transducer of the aforementioned first or second embodiment are assigned the same reference numerals, and their repeated explanations are omitted.

In the mount structure 30 of the electromechanical acoustic transducer, a wall portion 31 is formed from a member exhibiting elasticity.

Specifically, one side surface of the sound channel 14 is built from an elastic member. The elastic element is not limited to a specific material or shape. However, it is desirable to form the elastic element from; for instance, foam urethane rubber, or the like, and to ensure airtight-ness by holding the elastic element between the frame 12 and the housing 11 of the electromechanical acoustic transducer.

It is desirable for the frame 12 and the housing 11, which contact the wall portion 31 corresponding to an elastic element, to assure airtight-ness by use of an adhesive double-sided tape.

Operation of the mount structure 30 of the electromechanical acoustic transducer is the same as that of the mount structure 10 of the electromechanical acoustic transducer described in connection with the foregoing first embodiment.

The mount structure 30 of the electromechanical acoustic transducer of the foregoing third embodiment of the present invention enables enhancement of magnetic-proof and dust-proof characteristics as well as assurance of acoustic performance as in the first embodiment. Further, since the wall portion 31 has elasticity, vibration-proof can be enhanced.

Fourth Embodiment

A mount structure of an electromechanical acoustic transducer of a fourth embodiment of the present invention will now be described.

Figure 5:
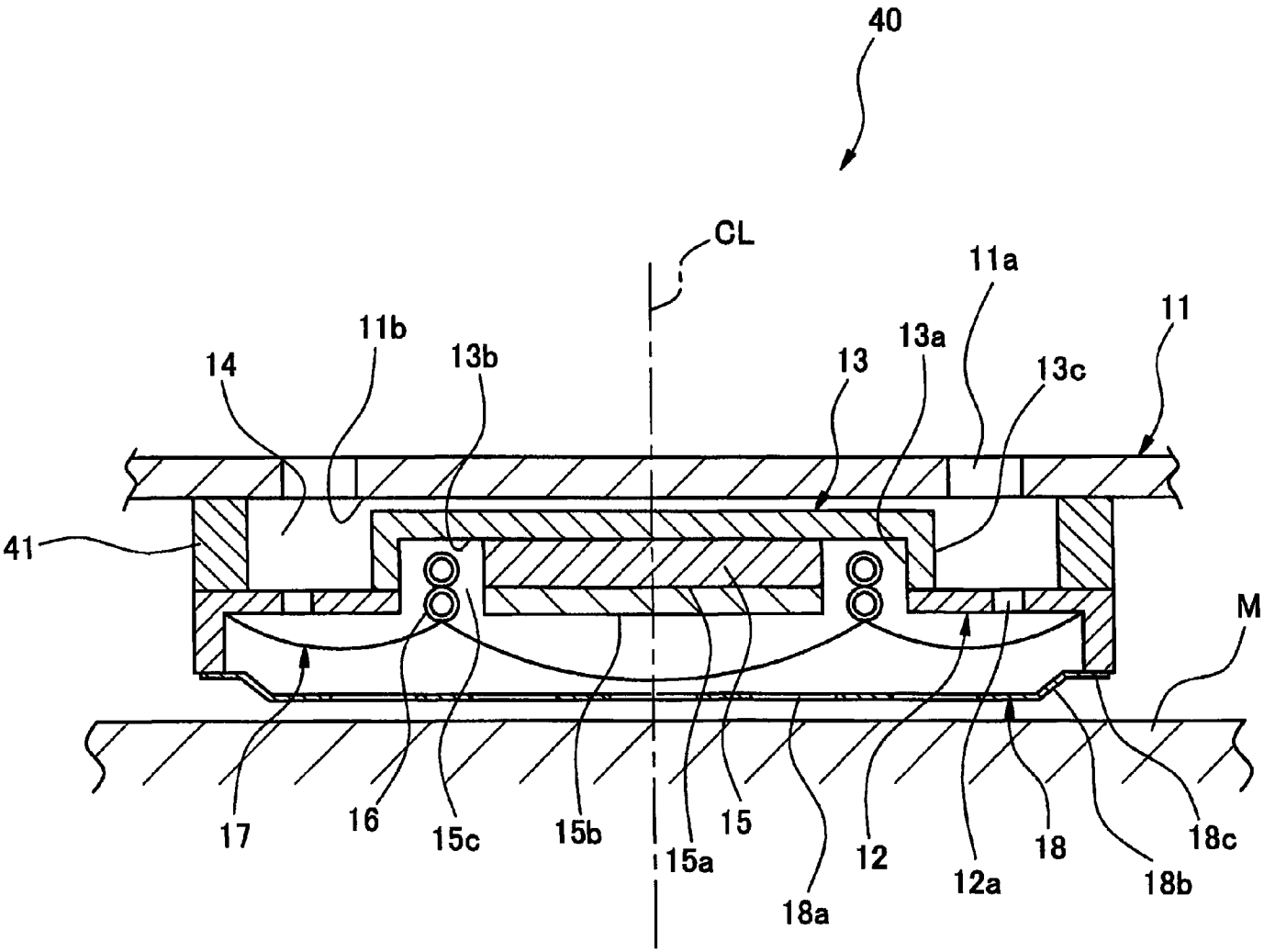
FIG. 5 is a structural view showing a mount structure of an electromechanical acoustic transducer of a fourth embodiment of the present invention.

A mount structure 40 of an electromechanical acoustic transducer of the fourth embodiment is shown in FIG. 5.

Areas common to those of the mount structure 10, 20, or 30 of the electromechanical acoustic transducer of the aforementioned first, second, or third embodiment are assigned the same reference numerals, and their repeated explanations are omitted.

In the mount structure 40 of the electromechanical acoustic transducer, a wall portion 41 is formed from a member exhibiting a damping characteristic. The wall portion 41 having a damping characteristic is not limited to any specific material or shape. It is desirable to form the wall portion from; for instance, a silicon-based gel material, or the like, and hold the wall portion between the frame 12 and the housing 11, to thus assure airtight-ness. It is desirable for the frame 12 and the housing 11, which contact the wall portion 41, to assure airtight-ness by mutually projecting shapes.

Operation of the mount structure 40 of the electromechanical acoustic transducer is the same as that of the mount structure 10 of the electromechanical acoustic transducer described in connection with the foregoing first embodiment.

The mount structure 40 of the electromechanical acoustic transducer of the foregoing fourth embodiment of the present invention enables enhancement of magnetic-proof and dust-proof characteristics as well as assurance of acoustic performance as in the first embodiment. Further, since the wall portion 41 has a damping characteristic, vibration-proof can be enhanced.

Fifth Embodiment

A mount structure of an electromechanical acoustic transducer of a fifth embodiment of the present invention will now be described.

Figure 6:
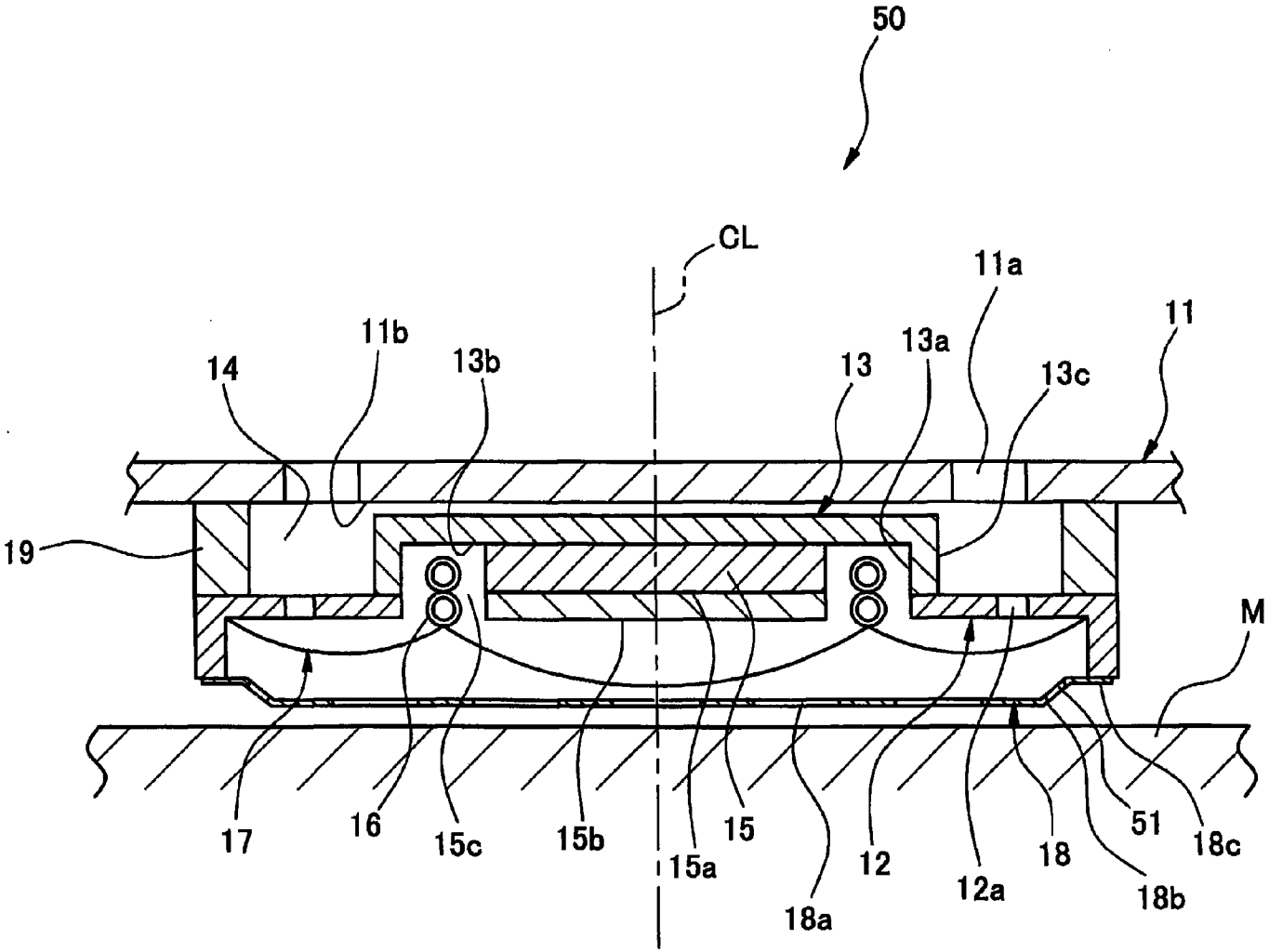
FIG. 6 is a structural view showing a mount structure of an electromechanical acoustic transducer of a fifth embodiment of the present invention.

A mount structure 50 of an electromechanical acoustic transducer of the fifth embodiment is shown in FIG. 6. Areas common to those of the mount structures 10 . . . 40 of the electromechanical acoustic transducers of the aforementioned first through fourth embodiments are assigned the same reference numerals, and their repeated explanations are omitted.

In the mount structure 50 of the electromechanical acoustic transducer, a protector cutout portion 51 is provided in the protector 18, and the protector cutout portion 51 is provided so as to establish mutual communication between the front and back of the protector 16 along a direction (the horizontal direction in FIG. 6) crossing the direction of movement of the voice coil 16 (the vertical direction in FIG. 6). The protector cutout portion 51 is not limited to any specific shape but penetrates through; for instance, a rising portion 18*b* of the protector 18, in the horizontal direction in FIG. 6, thereby further facilitating escape of air from the first air holes 18*a*.

Operation of the mount structure 50 of the electromechanical acoustic transducer is the same as that of the mount structure 10 of the electromechanical acoustic transducer described in connection with the foregoing first embodiment.

The mount structure 50 of the electromechanical acoustic transducer of the foregoing fifth embodiment of the present invention enables enhancement of magnetic-proof and dust-proof characteristics as well as assurance of acoustic performance as in the first embodiment. Further, as a result of the protector cutout portion 51 being provided in the protector 18, escape of air is further facilitated, whereupon acoustic performance can be enhanced.

Sixth Embodiment

A mount structure of an electromechanical acoustic transducer of a sixth embodiment of the present invention will now be described.

Figure 7:
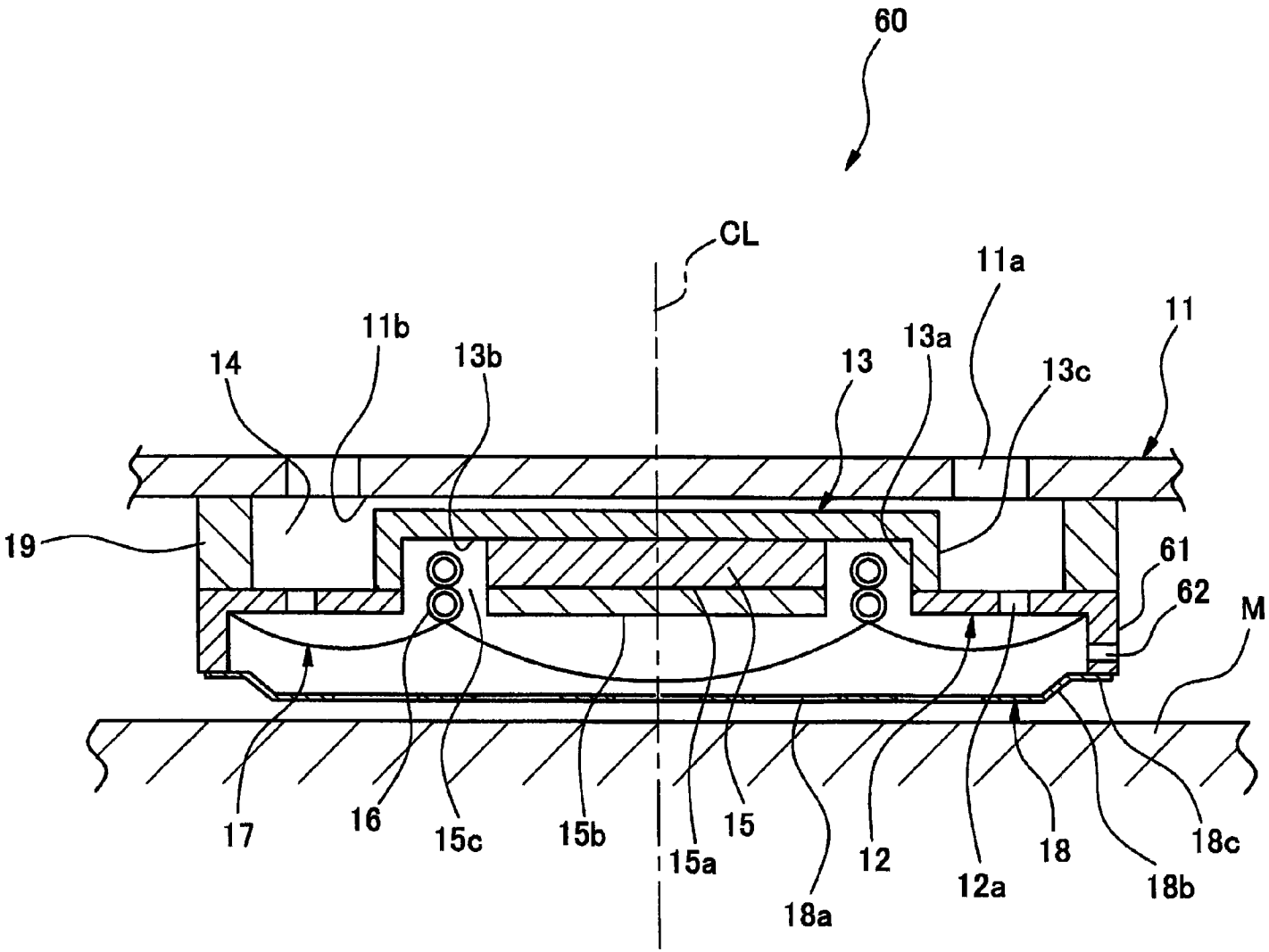
FIG. 7 is a structural view showing a mount structure of an electromechanical acoustic transducer of a sixth embodiment of the present invention.

A mount structure 60 of an electromechanical acoustic transducer of the sixth embodiment is shown in FIG. 7. Areas common to those of the mount structures 10 . . . 50 of the electromechanical acoustic transducers of the aforementioned first through fifth embodiments are assigned the same reference numerals, and their repeated explanations are omitted.

In the mount structure 60 of the electromechanical acoustic transducer, the frame 12 has a rising portion 61 that stands in a thickness direction and a frame cutout portion 62 provided in the rising portion 61. The frame cutout portion 62 is arranged so as to establish mutual communication between the outside and inside of the rising portion 61 along a direction (the horizontal direction in FIG. 7) crossing the direction of movement of the voice coil 16. The frame cutout portion 62 is not limited to any specific shape; however, it is desirable to provide the frame cutout portion so as to be oriented in the horizontal direction of the electromechanical acoustic transducer such that escape of air from the first air holes 18*a* is much facilitated.

Operation of the mount structure 60 of the electromechanical acoustic transducer is the same as that of the mount structure 10 of the electromechanical acoustic transducer described in connection with the foregoing first embodiment.

The mount structure 60 of the electromechanical acoustic transducer of the foregoing sixth embodiment of the present invention enables enhancement of magnetic-proof and dust-proof characteristics as well as assurance of acoustic performance as in the first embodiment. Further, as a result of the rising portion 61, which stands in the thickness direction, being provided in the frame 12 and the frame cutout portion 62 being provided in the rising portion 61, escape of air is further facilitated, whereupon acoustic performance can be enhanced.

Seventh Embodiment

A mount structure of an electromechanical acoustic transducer of a seventh embodiment of the present invention will now be described.

Figure 8:
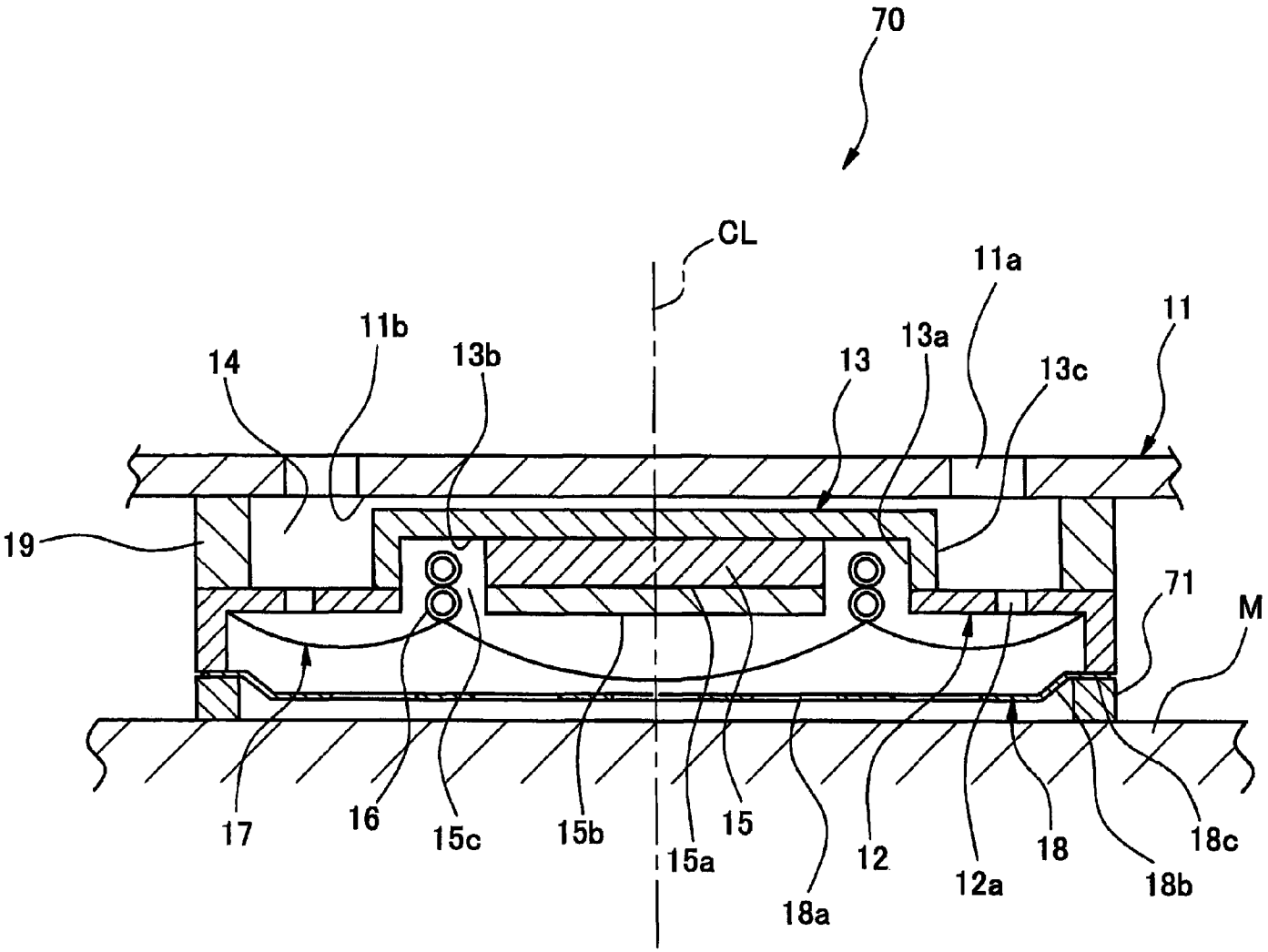
FIG. 8 is a structural view showing a mount structure of an electromechanical acoustic transducer of a seventh second embodiment of the present invention.

A mount structure 70 of an electromechanical acoustic transducer of the seventh embodiment is shown in FIG. 8. Areas common to those of the mount structures 10 . . . 60 of the electromechanical acoustic transducers of the aforementioned first through sixth embodiments are assigned the same reference numerals, and their repeated explanations are omitted.

The mount structure 70 of the electromechanical acoustic transducer has a support member 71 interposed between the frame 12 and the electronic component M housed in the housing 11, and the support member 71 has elasticity.

The support member 71 is not limited to any specific material or shape. However, it is desirable to form the support member from; for instance, foam urethane rubber, or the like, and build the support member from; for instance, a plurality of blocks, so as to prevent escape of air from the first air holes 18*a* or generate the support member into a shape having an opening, such as the shape of the letter C. Operation of the mount structure 70 of the electromechanical acoustic transducer is the same as that of the mount structure 10 of the electromechanical acoustic transducer described in connection with the foregoing first embodiment.

The mount structure 70 of the electromechanical acoustic transducer of the foregoing seventh embodiment of the present invention enables enhancement of magnetic-proof and dust-proof characteristics as well as assurance of acoustic performance as in the first embodiment. Further, as a result of the elastic support member 71 being interposed between the frame 12 and the electronic component M housed in the housing 11, escape of air from the location is prevented, so that acoustic performance can be enhanced.

Eighth Embodiment

A mount structure of an electromechanical acoustic transducer of an eighth embodiment of the present invention will now be described.

Figure 9:
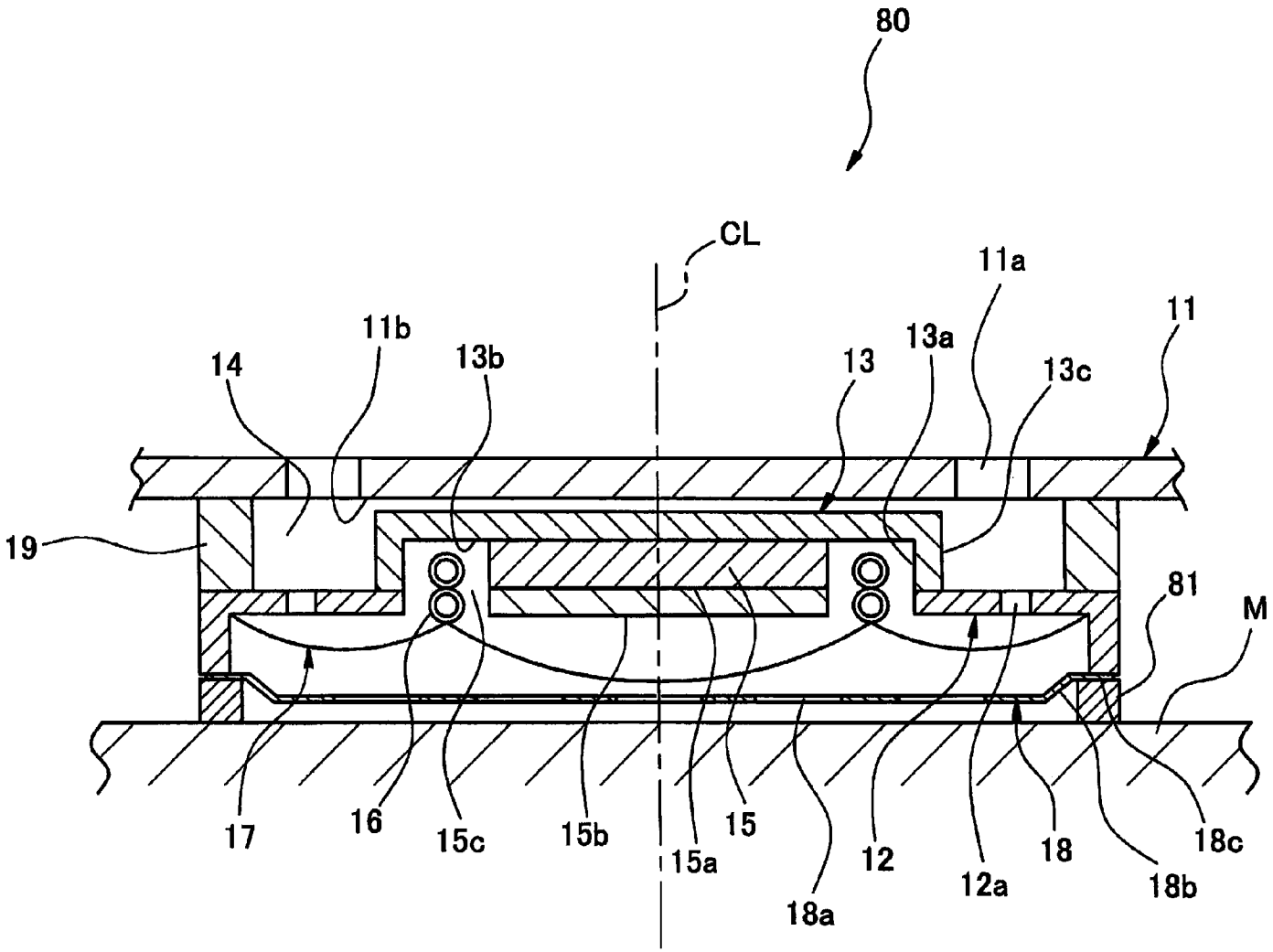
FIG. 9 is a structural view showing a mount structure of an electromechanical acoustic transducer of an eighth embodiment of the present invention.

A mount structure 80 of an electromechanical acoustic transducer of the eighth embodiment is shown in FIG. 9.

Areas common to those of the mount structures 10 . . . 70 of the electromechanical acoustic transducer of the aforementioned first through seventh embodiments are assigned the same reference numerals, and their repeated explanations are omitted.

The mount structure 80 of the electromechanical acoustic transducer has a support member 81 interposed between the frame 12 and the electronic component M housed in the housing 11, and the support member 81 exhibits a damping characteristic. The support member 81 is not limited to any specific material or shape. It is desirable to form the support member from; for instance, a silicon-based gel material, or the like, and build the support member from; for instance, a plurality of blocks, so as to prevent escape of air from the first air holes 18*a* or generate the support member into a shape having an opening, such as the shape of the letter C.

Operation of the mount structure 80 of the electromechanical acoustic transducer is the same as that of the mount structure 10 of the electromechanical acoustic transducer described in connection with the foregoing first embodiment.

The mount structure 80 of the electromechanical acoustic transducer of the foregoing eighth embodiment of the present invention enables enhancement of magnetic-proof and dust-proof characteristics as well as assurance of acoustic performance as in the first embodiment. Further, as a result of the support member 81 having a damping characteristic being interposed between the frame 12 and the electronic component M housed in the housing 11, escape of air from the location is prevented, so that acoustic performance can be enhanced.

The electro-dynamic speaker is used as the electromechanical acoustic transducer in the foregoing descriptions. However, a similar advantage is yielded even when any electromechanical acoustic transducer is used, so long as the transducer has a shape, such as projection of the yoke 13 with respect to the frame 12, as in an electro-dynamic receiver, and the like.

Although descriptions have been provided for the case where the outer shape of the electromechanical acoustic transducer is round, a similar advantage is yielded even when the transducer assumes another shape, such as an oval or rectangular shape.

INDUSTRIAL APPLICABILITY

As mentioned above, in the mount structures of the electromechanical acoustic transducers of the present embodiments, the cylindrical closed-end yoke is attached to the frame, which is attached to the interior surface of the housing by way of the wall portion, in a direction in which the bottom of the yoke approaches the housing. Hence, the sound channel is defined between the yoke and the wall portion without an increase in the thickness of the electromechanical acoustic transducer, so that a superior acoustic characteristic can be acquired.

Alternatively, even when the electromechanical acoustic transducer is miniaturized, the sound channel can be assured; hence, there is yielded an advantage of the ability to attempt to pursuit miniaturization while maintaining an acoustic characteristic. The mount structure is useful as a mount structure of an electromechanical acoustic transducer, such as a speaker and a microphone, housed in a housing having a sound port.

The invention claimed is:

1. A mount structure of an electromechanical acoustic transducer housed in a housing, comprising:

a frame having a hollow portion, a first frame surface and a second frame surface opposite the first frame surface, and a hole linking the first frame surface of the frame and the second frame surface of the frame;

a wall connected to the first frame surface and to an inner surface of the housing, thereby supporting the frame;

a yoke supported by the first frame surface of the frame, the yoke protruding from the first frame surface toward the inner surface, thereby a housing space for housing a magnet and a voice coil is formed by the protruding yoke and the hollow portion, wherein a distance between at least a portion of the protruding yoke and the inner surface of the housing is less than a distance between a portion of the first frame surface supporting the yoke and the inner surface of the housing; and a diaphragm connected to the voice coil and supported by the second frame surface of the frame.

2. The mount structure according to claim 1, further comprising:

a protector covering the diaphragm and including a first protector surface facing the diaphragm and a second protector surface opposite the first protector surface, the protector covering further including a hole extending between the first protector surface to the second protector surface.

3. The mount structure according to claim 2, wherein the protector has a rising portion connected to the second frame surface by a fringe portion of the protector, and a protector cutout portion disposed on the rising portion, the protector cutout portion extending between the first protector surface and the second protector surface.

4. The mount structure according to claim 1, wherein an interposition member having adhesiveness is disposed between the inner surface of the housing and the protruding portion of the yoke.

5. The mount structure according to claim 1, wherein the wall portion has elasticity.

6. The mount structure according to claim 1, wherein the wall portion has damping characteristic.

7. The mount structure according to claim 1, wherein the frame has a protruding portion supporting the protector, thereby the housing space includes a space formed by the protruding portion of the frame and the protector and houses the diaphragm, and the protruding portion of the frame has a frame cutout portion linking an outer area of the housing space and an inner area of the housing space.

8. The mount structure according to claim 1, further comprising:

a support member disposed between the frame and an electronic component housed in the housing, wherein the support member has elasticity.

9. The mount structure according to claim 1, comprising:

a support member disposed between the frame and an electronic component housed in the housing, wherein the support member has a damping characteristic.

10. A portable terminal device comprising an electromechanical acoustic transducer described in claim 1.

* * * * *